US008595002B2

(12) United States Patent
Hardwick

(10) Patent No.: US 8,595,002 B2
(45) **Date of Patent: *Nov. 26, 2013**

(54) HALF-RATE VOCODER

(71) Applicant: Digital Voice Systems, Inc., Westford, MA (US)

(72) Inventor: John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/744,569

(22) Filed: Jan. 18, 2013

(65) Prior Publication Data

US 2013/0144613 A1 Jun. 6, 2013

Related U.S. Application Data

(63) Continuation of application No. 10/402,938, filed on Apr. 1, 2003, now Pat. No. 8,359,197.

(51) Int. Cl.
*G10L 19/12* (2013.01)
*G10L 19/00* (2013.01)
*G10L 19/005* (2013.01)

(52) U.S. Cl.
USPC ..... 704/223; 704/219; 704/208

(58) Field of Classification Search
USPC ..... 704/208, 219–220, 223, 230
See application file for complete search history.

(56) References Cited

U.S. PATENT DOCUMENTS 3,622,704 A 11/1971 Ferrieu et al.
3,903,366 A 9/1975 Coulter
5,081,681 A 1/1992 Hardwick et al.
5,086,475 A 2/1992 Kutaragi et al.
5,195,166 A 3/1993 Hardwick et al.
5,216,747 A 6/1993 Hardwick et al.
5,226,084 A 7/1993 Hardwick et al.
5,226,108 A 7/1993 Hardwick et al.
5,247,579 A 9/1993 Hardwick et al.

(Continued)

FOREIGN PATENT DOCUMENTS

EP 0 893 791 A2 1/1999
EP 1 020 848 A2 7/2000

(Continued)

OTHER PUBLICATIONS

Mears, J.C. Jr., "High-speed error correcting encoder/decoder," IBM Technical Disclosure Bulletin USA, vol. 23, No. 5, Oct. 1980, pp. 2135-2136.

(Continued)

*Primary Examiner* — Angela A Armstrong

(74) *Attorney, Agent, or Firm* — Fish & Richardson P.C.

(57) ABSTRACT

Encoding a sequence of digital speech samples into a bit stream includes dividing the digital speech samples into one or more frames, computing model parameters for a frame, and quantizing the model parameters to produce pitch bits conveying pitch information, voicing bits conveying voicing information, and gain bits conveying signal level information. One or more of the pitch bits are combined with one or more of the voicing bits and one or more of the gain bits to create a first parameter codeword that is encoded with an error control code to produce a first FEC codeword that is included in a bit stream for the frame. The process may be reversed to decode the bit stream.

80 Claims, 6 Drawing Sheets

(56) References Cited

U.S. PATENT DOCUMENTS

| | | | | |
|---|---|---|---|---|
| 5,473,727 | A | 12/1995 | Nishiguchi et al. | |
| 5,491,772 | A | 2/1996 | Hardwick et al. | |
| 5,517,511 | A | 5/1996 | Hardwick et al. | |
| 5,581,656 | A | 12/1996 | Hardwick et al. | |
| 5,630,011 | A | 5/1997 | Lim et al. | |
| 5,649,050 | A | 7/1997 | Hardwick et al. | |
| 5,664,051 | A | 9/1997 | Hardwick et al. | |
| 5,664,052 | A | 9/1997 | Nishiguchi et al. | |
| 5,701,390 | A | 12/1997 | Griffin et al. | |
| 5,715,365 | A | 2/1998 | Griffin et al. | |
| 5,742,930 | A | 4/1998 | Howitt | |
| 5,754,974 | A | 5/1998 | Griffin et al. | |
| 5,826,222 | A | 10/1998 | Griffin | |
| 5,870,405 | A | 2/1999 | Hardwick et al. | |
| 6,018,706 | A | 1/2000 | Huang et al. | |
| 6,064,955 | A | 5/2000 | Huang et al. | |
| 6,131,084 | A | 10/2000 | Hardwick | |
| 6,161,089 | A | 12/2000 | Hardwick | |
| 6,199,037 | B1 | 3/2001 | Hardwick | |
| 6,377,916 | B1 | 4/2002 | Hardwick | |
| 6,484,139 | B2 | 11/2002 | Yajima | |
| 6,496,798 | B1 | 12/2002 | Huang et al. | |
| 6,502,069 | B1 | 12/2002 | Grill et al. | |
| 6,675,148 | B2 | 1/2004 | Hardwick | |
| 6,912,495 | B2 | 6/2005 | Griffin et al. | |
| 6,963,833 | B1 | 11/2005 | Singhal | |
| 8,359,197 | B2 * | 1/2013 | Hardwick | 704/223 |
| 2003/0135374 | A1 | 7/2003 | Hardwick | |
| 2004/0093206 | A1 | 5/2004 | Hardwick | |
| 2004/0153316 | A1 | 8/2004 | Hardwick | |

FOREIGN PATENT DOCUMENTS

| | | | |
|---|---|---|---|
| EP | 1 237 284 | A1 | 9/2002 |
| JP | 03-51900 | A | 3/1991 |
| JP | 5-346797 | A | 12/1993 |
| JP | 06-149296 | A | 5/1994 |
| JP | 10-293600 | A | 11/1998 |
| WO | 98/4046 | A2 | 1/1998 |

OTHER PUBLICATIONS

Rowe, D. et al., "A Robust 2400 bit/s MBE-LPC Speech Coder Incorporating Joint Source and Channel Coding," Digital Signal Processing 2, Estimation, VLSI, San Francisco, vol. 5, Conf. 17, Mar. 23, 1992, pp. 141-144.

Das, A. et al., "A Variable-Rate Natural-Quality Parametric Speech Coder," Supercomm/ICC '94, Conference Record, 'Serving Humanity Through Communications', IEEE International Conference on New Orleans, LA, May 1, 1994, pp. 216-220.

European Search Report (Application No. 06076855.3), Apr. 2, 2007, 6 pages.

Office Action (Japanese Patent Application No. 2004-101889) mailed Dec. 14, 2009 (English translation only).

Office Action (Japanese Patent Application No. 2004-101889) mailed Jul. 2, 2010 (English translation only).

* cited by examiner

HALF-RATE VOCODER

CROSS-REFERENCE TO RELATED APPLICATIONS

This application is a continuation of U.S. application Ser. No. 10/402,938, filed Apr. 1, 2003, now allowed, which is incorporated by reference.

TECHNICAL FIELD

This description relates generally to the encoding and/or decoding of speech, tone and other audio signals.

BACKGROUND

Speech encoding and decoding have a large number of applications and have been studied extensively. In general, speech coding, which is also known as speech compression, seeks to reduce the data rate needed to represent a speech signal without substantially reducing the quality or intelligibility of the speech. Speech compression techniques may be implemented by a speech coder, which also may be referred to as a voice coder or vocoder.

A speech coder is generally viewed as including an encoder and a decoder. The encoder produces a compressed stream of bits from a digital representation of speech, such as may be generated at the output of an analog-to-digital converter having as an input an analog signal produced by a microphone. The decoder converts the compressed bit stream into a digital representation of speech that is suitable for playback through a digital-to-analog converter and a speaker. In many applications, the encoder and the decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. Recently, low to medium rate speech coders operating below 10 kbps have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Speech is generally considered to be a non-stationary signal having signal properties that change over time. This change in signal properties is generally linked to changes made in the properties of a person's vocal tract to produce different sounds. A sound is typically sustained for some short period, typically 10-100 ms, and then the vocal tract is changed again to produce the next sound. The transition between sounds may be slow and continuous or it may be rapid as in the case of a speech "onset." This change in signal properties increases the difficulty of encoding speech at lower bit rates since some sounds are inherently more difficult to encode than others and the speech coder must be able to encode all sounds with reasonable fidelity while preserving the ability to adapt to a transition in the characteristics of the speech signals. Performance of a low to medium bit rate speech coder can be improved by allowing the bit rate to vary. In variable-bit-rate speech coders, the bit rate for each segment of speech is allowed to vary between two or more options depending on various factors, such as user input, system loading, terminal design or signal characteristics.

There have been several main approaches for coding speech at low to medium data rates. For example, an approach based around linear predictive coding (LPC) attempts to predict each new frame of speech from previous samples using short and long term predictors. The prediction error is typically quantized using one of several approaches of which CELP and/or multi-pulse are two examples. The advantage of the linear prediction method is that it has good time resolution, which is helpful for the coding of unvoiced sounds. In particular, plosives and transients benefit from this in that they are not overly smeared in time. However, linear prediction typically has difficulty for voiced sounds in that the coded speech tends to sound rough or hoarse due to insufficient periodicity in the coded signal. This problem may be more significant at lower data rates that typically require a longer frame size and for which the long-term predictor is less effective at restoring periodicity.

Another leading approach for low to medium rate speech coding is a model-based speech coder or vocoder. A vocoder models speech as the response of a system to excitation over short time intervals. Examples of vocoder systems include linear prediction vocoders such as MELP, homomorphic vocoders, channel vocoders, sinusoidal transform coders ("STC"), harmonic vocoders and multiband excitation ("MBE") vocoders. In these vocoders, speech is divided into short segments (typically 10-40 ms), with each segment being characterized by a set of model parameters. These parameters typically represent a few basic elements of each speech segment, such as the segment's pitch, voicing state, and spectral envelope. A vocoder may use one of a number of known representations for each of these parameters. For example, the pitch may be represented as a pitch period, a fundamental frequency or pitch frequency (which is the inverse of the pitch period), or a long-term prediction delay. Similarly, the voicing state may be represented by one or more voicing metrics, by a voicing probability measure, or by a set of voicing decisions. The spectral envelope is often represented by an all-pole filter response, but also may be represented by a set of spectral magnitudes or other spectral measurements. Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

The MBE vocoder is a harmonic vocoder based on the MBE speech model that has been shown to work well in many applications. The MBE vocoder combines a harmonic representation for voiced speech with a flexible, frequency-dependent voicing structure based on the MBE speech model. This allows the MBE vocoder to produce natural sounding unvoiced speech and makes the MBE vocoder more robust to the presence of acoustic background noise. These properties allow the MBE vocoder to produce higher quality speech at low to medium data rates and have led to its use in a number of commercial mobile communication applications.

The MBE speech model represents segments of speech using a fundamental frequency corresponding to the pitch, a set of voicing metrics or decisions, and a set of spectral magnitudes corresponding to the frequency response of the vocal tract. The MBE model generalizes the traditional single V/UV decision per segment into a set of decisions that each represent the voicing state within a particular frequency band or region. Each frame is thereby divided into at least voiced and unvoiced frequency regions. This added flexibility in the voicing model allows the MBE model to better accommodate mixed voicing sounds, such as some voiced fricatives, allows a more accurate representation of speech that has been corrupted by acoustic background noise, and reduces the sensitivity to an error in any one decision. Extensive testing has shown that this generalization results in improved voice quality and intelligibility.

MBE-based vocoders include the IMBE™ speech coder which has been used in a number of wireless communications systems including the APCO Project 25 ("P25") mobile radio standard. This P25 vocoder standard consists of a 7200 bps IMBE™ vocoder that combines 4400 bps of compressed voice data with 2800 bps of Forward Error Control (FEC) data. It is documented in Telecommunications Industry Association (TIA) document TIA-102BABA, entitled "APCO Project 25 Vocoder Description," which is incorporated by reference.

The encoder of a MBE-based speech coder estimates a set of model parameters for each speech segment or frame. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes (FEC) before interleaving and transmitting the resulting bit stream to a corresponding decoder.

The decoder in a MBE-based vocoder reconstructs the MBE model parameters (fundamental frequency, voicing information and spectral magnitudes) for each segment of speech from the received bit stream. As part of this reconstruction, the decoder may perform deinterleaving and error control decoding to correct and/or detect bit errors. In addition, the decoder typically performs phase regeneration to compute synthetic phase information. For example, in a method specified in the APCO Project 25 Vocoder Description and described in U.S. Pat. Nos. 5,081,681 and 5,664,051, random phase regeneration is used, with the amount of randomness depending on the voicing decisions.

The decoder uses the reconstructed MBE model parameters to synthesize a speech signal that perceptually resembles the original speech to a high degree. Normally, separate signal components, corresponding to voiced, unvoiced, and optionally pulsed speech, are synthesized for each segment, and the resulting components are then added together to form the synthetic speech signal. This process is repeated for each segment of speech to reproduce the complete speech signal, which can then be output through a D-to-A converter and a loudspeaker. The unvoiced signal component may be synthesized using a windowed overlap-add method to filter a white noise signal. The time-varying spectral envelope of the filter is determined from the sequence of reconstructed spectral magnitudes in frequency regions designated as unvoiced, with other frequency regions being set to zero.

The decoder may synthesize the voiced signal component using one of several methods. In one method, specified in the APCO Project 25 Vocoder Description, a bank of harmonic oscillators is used, with one oscillator assigned to each harmonic of the fundamental frequency, and the contributions from all of the oscillators is summed to form the voiced signal component.

The 7200 bps IMBE™ vocoder, standardized for the APCO Project 25 mobile radio communication system, uses 144 bits to represent each 20 ms frame. These bits are divided into 56 redundant FEC bits (applied as a combination of Golay and Hamming codes), 1 synchronization bit and 87 MBE parameter bits. The 87 MBE parameter bits consist of 8 bits to quantize the fundamental frequency, 3-12 bits to quantize the binary voiced/unvoiced decisions, and 67-76 bits to quantize the spectral magnitudes. The resulting 144 bit frame is transmitted from the encoder to the decoder. The decoder performs error correction decoding before reconstructing the MBE model parameters from the error-decoded bits. The decoder then uses the reconstructed model parameters to synthesize voiced and unvoiced signal components which are added together to form the decoded speech signal.

SUMMARY

In one general aspect, encoding a sequence of digital speech samples into a bit stream includes dividing the digital speech samples into one or more frames, computing model parameters for a frame, and quantizing the model parameters to produce pitch bits conveying pitch information, voicing bits conveying voicing information, and gain bits conveying signal level information. One or more of the pitch bits are combined with one or more of the voicing bits and one or more of the gain bits to create a first parameter codeword that is encoded with an error control code to produce a first FEC codeword. The first FEC codeword is included in a bit stream for the frame.

Implementations may include one or more of the following features. For example, computing the model parameters for the frame may include computing a fundamental frequency parameter, one or more of voicing decisions, and a set of spectral parameters. The parameters may be computed using the Multi-Band Excitation speech model.

Quantizing the model parameters may include producing the pitch bits by applying a logarithmic function to the fundamental frequency parameter, and producing the voicing bits by jointly quantizing voicing decisions for the frame. The voicing bits may represent an index into a voicing codebook, and the value of the voicing codebook may be the same for two or more different values of the index.

The first parameter codeword may include twelve bits. For example, the first parameter codeword may be formed by combining four of the pitch bits, four of the voicing bits, and four of the gain bits. The first parameter codeword may be encoded with a Golay error control code.

The spectral parameters may include a set of logarithmic spectral magnitudes, and the gain bits may be produced at least in part by computing the mean of the logarithmic spectral magnitudes. The logarithmic spectral magnitudes may be quantized into spectral bits; and at least some of the spectral bits may be combined to create a second parameter codeword that is encoded with a second error control code to produce a second FEC codeword that may be included in the bit stream for the frame.

The pitch bits, voicing bits, gain bits and spectral bits are each divided into more important bits and less important bits. The more important pitch bits, voicing bits, gain bits, and spectral bits are included in the first parameter codeword and the second parameter codeword and encoded with error control codes. The less important pitch bits, voicing bits, gain bits, and spectral bits are included in the bit stream for the frame without encoding with error control codes. In one implementation, there are 7 pitch bits divided into 4 more important pitch bits and 3 less important pitch bits, there are 5 voicing bits divided into 4 more important voicing bits and 1 less important voicing bit, and there are 5 gain bits divided into 4 more important gain bits and 1 less important gain bit. The second parameter code may include twelve more important spectral bits which are encoded with a Golay error control code to produce the second FEC codeword.

A modulation key may be computed from the first parameter codeword, and a scrambling sequence may be generated from the modulation key. The scrambling sequence may be combined with the second FEC codeword to produce a scrambled second FEC codeword to be included in the bit stream for the frame.

Certain tone signals may be detected. If a tone signal is detected for a frame, tone identifier bits and tone amplitude bits are included in the first parameter codeword. The tone identifier bits allow the bits for the frame to be identified as corresponding to a tone signal. If a tone signal is detected for a frame, additional tone index bits that determine frequency information for the tone signal may be included in the bit stream for the frame. The tone identifier bits may correspond to a disallowed set of pitch bits to permit the bits for the frame to be identified as corresponding to a tone signal. In certain implementations, the first parameter codeword includes six tone identifier bits and six tone amplitude bits if a tone signal is detected for a frame.

In another general aspect, decoding digital speech samples from a bit stream includes dividing the bit stream into one or more frames of bits, extracting a first FEC codeword from a frame of bits, and error control decoding the first FEC codeword to produce a first parameter codeword. Pitch bits, voicing bits and gain bits are extracted from the first parameter codeword. The extracted pitch bits are used to at least in part reconstruct pitch information for the frame, the extracted voicing bits are used to at least in part reconstruct voicing information for the frame, and the extracted gain bits are used to at least in part reconstruct signal level information for the frame. The reconstructed pitch information, voicing information and signal level information for one or more frames are used to compute digital speech samples.

Implementations may include one or more of the features noted above and one or more of the following features. For example, the pitch information for a frame may include a fundamental frequency parameter, and the voicing information for a frame may include one or more voicing decisions. The voicing decisions for the frame may be reconstructed by using the voicing bits as an index into a voicing codebook. The value of the voicing codebook may be the same for two or more different indices.

Spectral information for a frame also may be reconstructed. The spectral information for a frame may include at least in part a set of logarithmic spectral magnitude parameters. The signal level information may be used to determine the mean value of the logarithmic spectral magnitude parameters. The first FEC codeword may be decoded with a Golay decoder. Four pitch bits, four voicing bits, and four gain bits may be extracted from the first parameter codeword. A modulation key may be generated from the first parameter codeword, a scrambling sequence may be computed from the modulation key, and a second FEC codeword may be extracted from the frame of bits. The scrambling sequence may be applied to the second FEC codeword to produce a descrambled second FEC codeword that may be error control decoded to produce a second parameter codeword. The spectral information for a frame may be reconstructed at least in part from the second parameter codeword.

An error metric may be computed from the error control decoding of the first FEC codeword and from the error control decoding of the descrambled second FEC codeword, and frame error processing may be applied if the error metric exceeds a threshold value. The frame error processing may include repeating the reconstructed model parameter from a previous frame for the current frame. The error metric may use the sum of the number of errors corrected by error control decoding the first FEC codeword and by error control decoding the descrambled second FEC codeword.

In another general aspect, decoding digital signal samples from a bit stream includes dividing the bit stream into one or more frames of bits, extracting a first FEC codeword from a frame of bits, error control decoding the first FEC codeword to produce a first parameter codeword, and using the first parameter codeword to determine whether the frame of bits corresponds to a tone signal. If the frame of bits is determined to correspond to a tone signal, tone amplitude bits are extracted from the first parameter codeword. Otherwise, pitch bits, voicing bits, and gain bits are extracted from the first codeword if the frame of bits is determined to not correspond to a tone signal. Either the tone amplitude bits or the pitch bits, voicing bits and gain bits are used to compute digital signal samples.

Implementations may include one or more of the features noted above and one or more of the following features. For example, a modulation key may be generated from the first parameter codeword and a scrambling sequence may be computed from the modulation key. The scrambling sequence may be applied to a second FEC codeword extracted from the frame of bits to produce a descrambled second FEC codeword that may be error control decoded to produce a second parameter codeword. Digital signal samples may be computed using the second parameter codeword.

The number of errors corrected by the error control decoding of the first FEC codeword and by the error control decoding of the descrambled second FEC codeword may be summed to compute an error metric. Frame error processing may be applied if the error metric exceeds a threshold. The frame error processing may include repeating the reconstructed model parameter from a previous frame.

Additional spectral bits may be extracted from the second parameter codeword and used to reconstruct the digital signal samples. The spectral bits include tone index bits if the frame of bits is determined to correspond to a tone signal. The frame of bits may be determined to correspond to a tone signal if some of the bits in the first parameter codeword equal a known tone identifier value which corresponds to a disallowed value of the pitch bits. The tone index bits may be used to identify whether the frame of bits corresponds to a signal frequency tone, a DTMF tone, a Knox tone or a call progress tone.

The spectral bits may be used to reconstruct a set of logarithmic spectral magnitude parameters for the frame, and the gain bits may be used to determine the mean value of the logarithmic spectral magnitude parameters.

The first FEC codeword may be decoded with a Golay decoder. Four pitch bits, plus four voicing bits, plus four gain bits may be extracted from the first parameter codeword. The voicing bits may be used as an index into a voicing codebook to reconstruct voicing decisions for the frame.

In another general aspect, decoding a frame of bits into speech samples includes determining the number of bits in the frame of bits, extracting spectral bits from the frame of bits, and using one or more of the spectral bits to form a spectral codebook index, where the index is determined at least in part by the number of bits in the frame of bits. Spectral information is reconstructed using the spectral codebook index, and speech samples are computed using the reconstructed spectral information.

Implementations may include one or more of the features noted above and one or more of the following features. For example, pitch bits, voicing bits and gain bits may also be extracted from the frame of bits. The voicing bits may be used as an index into a voicing codebook to reconstruct voicing information which is also used to compute the speech samples. The frame of bits may be determined to correspond to a tone signal if some of the pitch bits and some of the voicing bits equal a known tone identifier value. The spectral information may include a set of logarithmic spectral magnitude parameters, and the gain bits may be used to determine the mean value of the logarithmic spectral magnitude parameters. The logarithmic spectral magnitude parameters for a frame may be reconstructed using the extracted spectral bits for the frame combined with the reconstructed logarithmic spectral magnitude parameters from a previous frame. The mean value of the logarithmic spectral magnitude parameters for a frame may be determined from the extracted gain bits for the frame and from the mean value of the logarithmic spectral magnitude parameters of a previous frame. In certain implementations, the frame of bits may include 7 pitch bits representing the fundamental frequency, 5 voicing bits representing voicing decisions, and 5 gain bits representing the signal level.

The techniques may be used to provide a "half-rate" MBE vocoder operating at 3600 bps can provide substantially the same or better performance than the standard "full-rate" 7200 bps APCO Project 25 vocoder even though the new vocoder operates at half the data rate. The much lower data rate for the half-rate vocoder can provide much better communications efficiency (i.e., the amount of RF spectrum required for transmission) compared to the standard full-rate vocoder.

In related application Ser. No. 10/353,974, filed Jan. 30, 2003, titled "Voice Transcoder", and incorporated by reference, a method is disclosed for providing interoperability between different MBE vocoders. This method can be applied to provide interoperability between current equipment using the full-rate vocoder and newer equipment using the half-rate vocoder described herein. Implementations of the techniques discussed above may include a method or process, a system or apparatus, or computer software on a computer-accessible medium. Other features will be apparent from the following description, including the drawings, and the claims.

DETAILED DESCRIPTION

Figure 1:
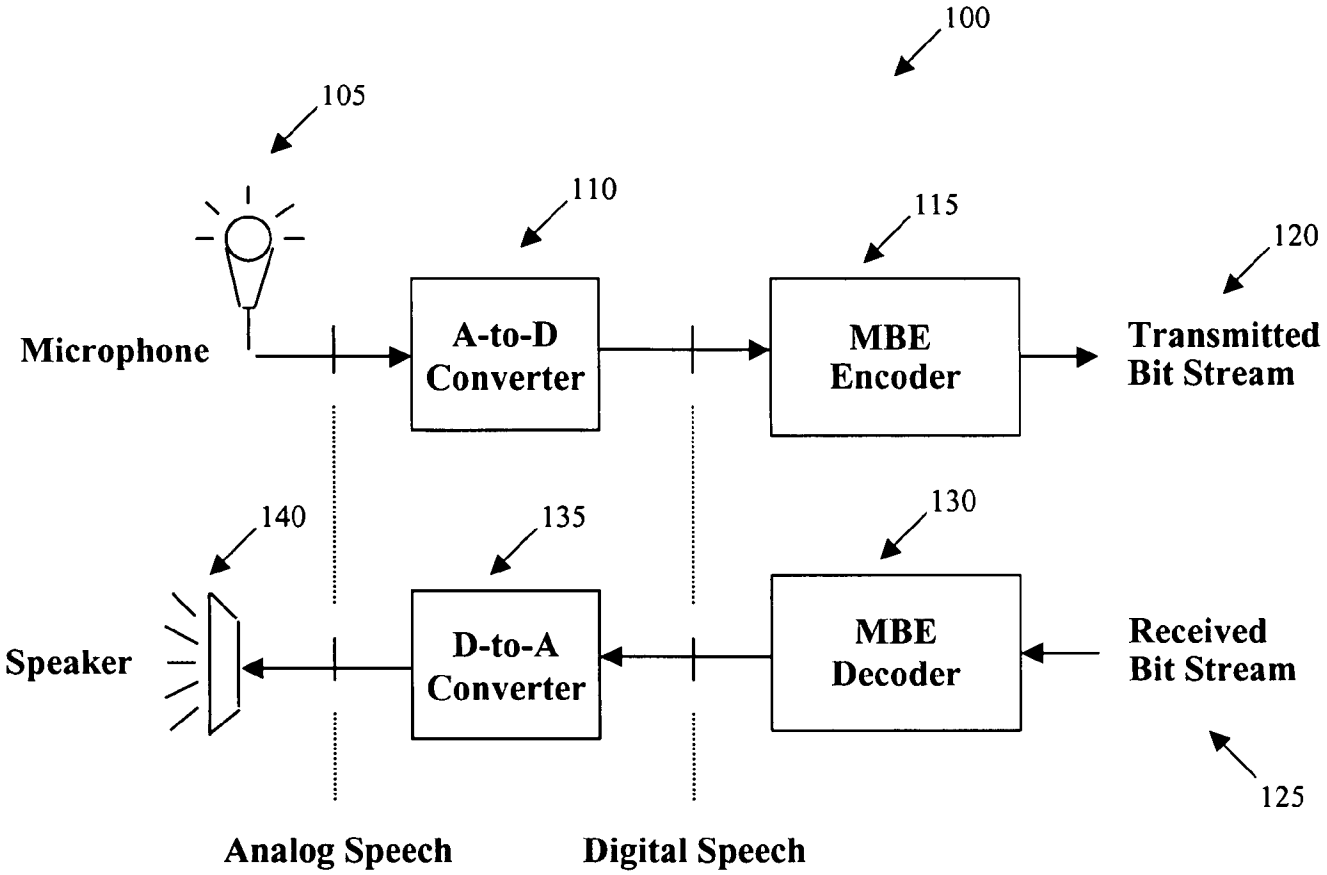
FIG. 1 is a block diagram of an application of a MBE vocoder.

FIG. 1 shows a speech coder or vocoder system 100 that samples analog speech or some other signal from a microphone 105. An analog-to-digital ("A-to-D") converter 110 digitizes the sampled speech to produce a digital speech signal. The digital speech is processed by a MBE speech encoder unit 115 to produce a digital bit stream 120 suitable for transmission or storage. Typically, the speech encoder processes the digital speech signal in short frames. Each frame of digital speech samples produces a corresponding frame of bits in the bit stream output of the encoder. In one implementation, the frame size is 20 ms in duration and consists of 160 samples at a 8 kHz sampling rate. Performance may be increased in some applications by dividing each frame into two 10 ms subframes.

FIG. 1 also depicts a received bit stream 125 entering a MBE speech decoder unit 130 that processes each frame of bits to produce a corresponding frame of synthesized speech samples. A digital-to-analog ("D-to-A") converter unit 135 then converts the digital speech samples to an analog signal that can be passed to a speaker unit 140 for conversion into an acoustic signal suitable for human listening.

Figure 2:
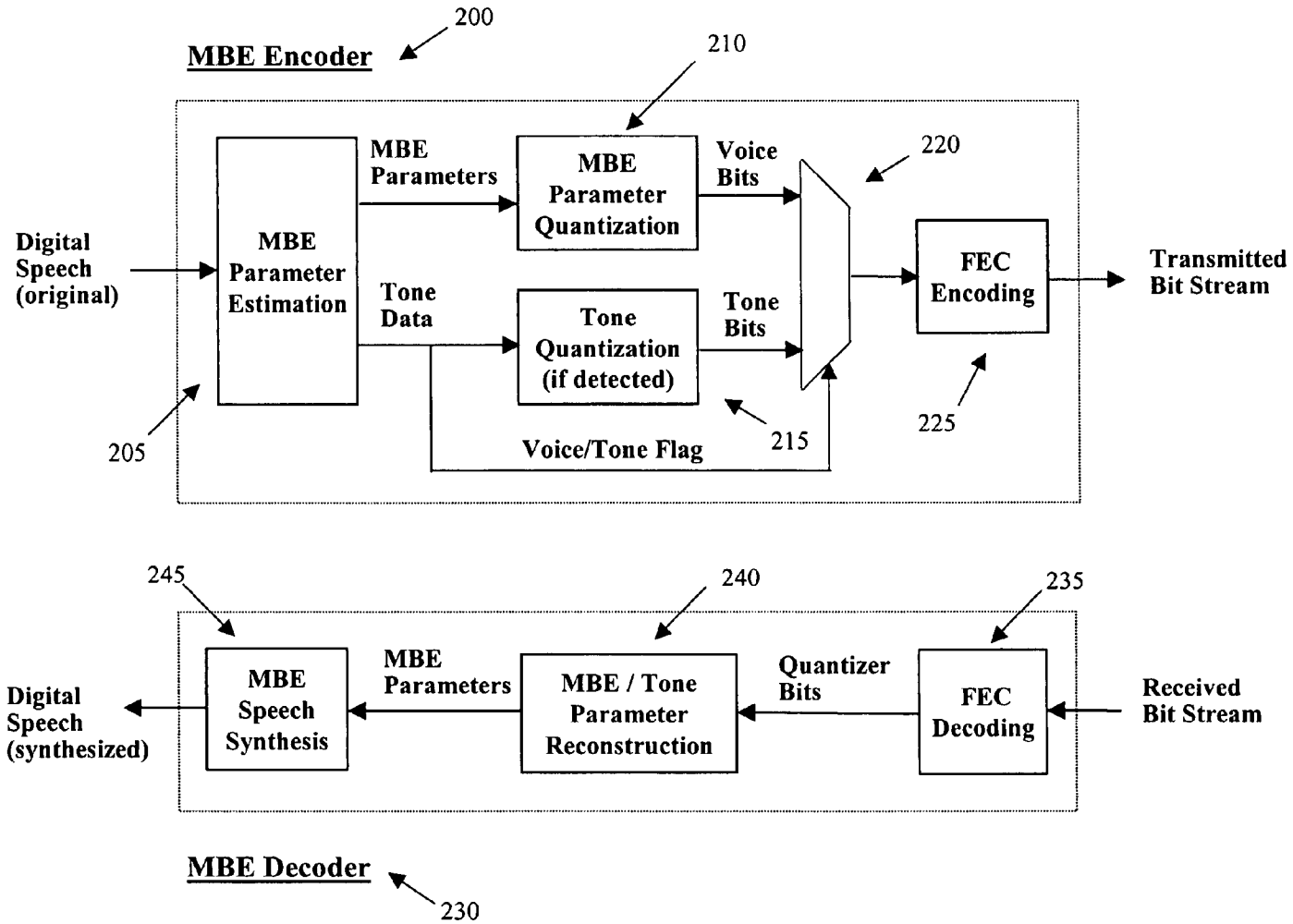
FIG. 2 is a block diagram of an implementation of a half-rate MBE vocoder including an encoder and a decoder.

FIG. 2 shows a MBE vocoder that includes a MBE encoder unit 200 that employs a parameter estimation unit 205 to estimate generalized MBE model parameters for each frame. Parameter estimation unit 205 also detects certain tone signals and outputs tone data including a voice/tone flag. The outputs for a frame are then processed by either MBE parameter quantization unit 210 to produce voice bits, or by a tone quantization unit 215 to produce tone bits, depending on whether a tone signal was detected for the frame. Selector unit 220 selects the appropriate bits (tone bits if a tone signal is detected or voice bits if no tone signal is detected), and the selected bits are output to FEC encoding unit 225, which combines the quantizer bits with redundant forward error correction ("FEC") data to form the transmitted bit for the frame. The addition of redundant FEC data enables the decoder to correct and/or detect bit errors caused by degradation in the transmission channel. In certain implementations, parameter estimation unit 205 does not detect tone signals and tone quantization unit 215 and selector unit 220 are not provided.

In one implementation, a 3600 bps MBE vocoder that is well suited for use in next generation radio equipment has been developed. This half-rate implementation uses a 20 ms frame containing 72 bits, where the bits are divided into 23 FEC bits and 49 voice or tone bits. The 23 FEC bits are formed from one [24,12] extended Golay code and one [23,12] Golay code. The FEC bits protect the 24 most sensitive bits of the frame and can correct and/or detect certain bit error patterns in these protected bits. The remaining 25 bits are less sensitive to bit errors and are not protected. The voice bits are divided into 7 bits to quantize the fundamental frequency, 5 bits to vector quantize the voicing decisions over 8 frequency bands, and 37 bits to quantize the spectral magnitudes. To increase the ability to detect bit errors in the most sensitive bits, data dependent scrambling is applied to the [23,12] Golay code within FEC encoding unit 225. A pseudo-random scrambling sequence is generated from a modulation key based on the 12 input bits to the [24,12] Golay code. An exclusive-OR then is used to combine this scrambling sequence with the 23 output bits from the [23,12] Golay encoder. Data dependent scrambling is described in U.S. Pat. Nos. 5,870,405 and 5,517,511, which are incorporated by reference. A [4×18] row-column interleaver is also applied to reduce the effect of burst errors.

FIG. 2 also shows a block diagram of a MBE decoder unit 230 that processes a frame of bits obtained from a received bit stream to produce an output digital speech signal. The MBE decoder includes FEC decoding unit 235 that corrects and/or detects bit errors in the received bit stream to produce voice or tone quantizer bits. The FEC decoding unit typically includes data dependent descrambling and deinterleaving as necessary to reverse the steps performed by the FEC encoder. The FEC decoder unit 235 may optionally use soft-decision bits, where each received bit is represented using more than two possible levels, in order to improve error control decoding performance. The quantizer bits for the frame are output by the FEC decoding unit 235 and processed by a parameter reconstruction unit 240 to reconstruct the MBE model parameters or tone parameters for the frame by inverting the quantization steps applied by the encoder. The resulting MBE or tone parameters then are used by a speech synthesis unit 245 to produce a synthetic digital speech signal or tone signal that is the output of the decoder.

In the described implementation, the FEC decoder unit 235 inverts the data dependent scrambling operation by first decoding the [24, 12] Golay code, to which no scrambling is applied, and then using the 12 output bits from the [24,12] Golay decoder to compute a modulation key. This modulation key is then used to compute a scrambling sequence which is applied to the 23 input bits prior to decoding the [23, 12] Golay code. Assuming the [24, 12] Golay code (containing the most important data) is decoded correctly, then the scrambling sequence applied by the encoder is completely removed. However if the [24, 12] Golay code is not decoded correctly, then the scrambling sequence applied by the encoder cannot be removed, causing many errors to be reported by the [23, 12] Golay decoder. This property is used by the FEC decoder to detect frames where the first 12 bits may have been decoded incorrectly.

The FEC decoder sums the number of corrected errors reported by both Golay decoders. If this sum is greater than or equal to 6, then the frame is declared invalid and the current frame of bits is not used during synthesis. Instead, the MBE synthesis unit 235 performs a frame repeat or a muting operation after three consecutive frame repeats. During a frame repeat, decoded parameters from a previous frame are used for the current frame. A low level "comfort noise" signal is output during a mute operation.

In one implementation of the half-rate vocoder shown in FIG. 2, the MBE parameter estimation unit 205 and the MBE synthesis unit 235 are generally the same as the corresponding units in the 7200 bps full-rate APCO P25 vocoder described in the APCO Project 25 Vocoder Description (TIA-102BABA). The sharing of these elements between the full-rate vocoder and the half-rate vocoder reduces the memory required to implement both vocoders, and thereby reduces the cost of implementing both vocoders in the same equipment. In addition, interoperability can be enhanced in this implementation by using the MBE transcoder methods disclosed in copending U.S. application Ser. No. 10/353,974, which was filed Jan. 30, 2003, is titled "Voice Transcoder," and is incorporated by reference. Alternate implementations may include different analysis and synthesis techniques in order to improve quality while remaining interoperable with the half-rate bit stream described herein. For example a three-state voicing model (voiced, unvoiced or pulsed) may be used to reduce distortion for plosive and other transient sounds while remaining interoperable using the method described in copending U.S. application Ser. No. 10/292,460, which was filed Nov. 13, 2002, is titled "Interoperable Vocoder," and is incorporated by reference. Similarly, a Voice Activity Detector (VAD) may be added to distinguish speech from background noise and/or noise suppression may be added to reduce the perceived amount of background noise. Another alternate implementation substitutes improved pitch and voicing estimation methods such as those described in U.S. Pat. Nos. 5,826,222 and 5,715,365 to improve voice quality.

Figure 3:
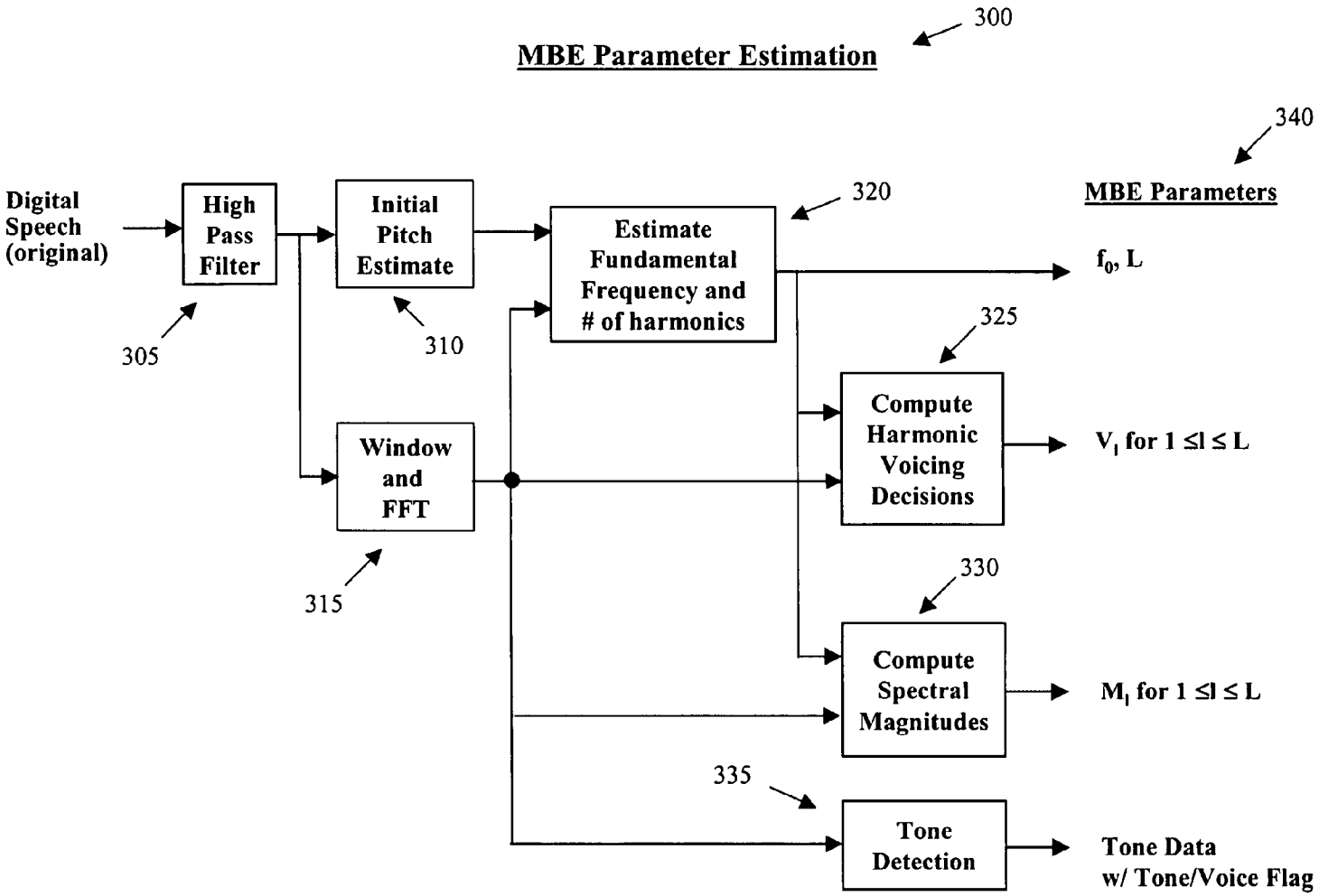
FIG. 3 is a block diagram of a MBE parameter estimator such as may be used in the half-rate MBE encoder of FIG. 2.

FIG. 3 shows a MBE parameter estimator 300 that represents one implementation of the MBE parameter estimation unit 205 of FIG. 2. A high pass filter 305 filters a digital speech signal to remove any DC level from the signal. Next, the filtered signal is processed by a pitch estimation unit 310 to determine an initial pitch estimate for each 20 ms frame. The filtered speech is also provided to a windowing and FFT unit 315 that multiplies the filtered speech by a window function, such as a 221 point Hamming window, and uses an FFT to compute the spectrum of the windowed speech.

The initial pitch estimate and the spectrum are then processed further by a fundamental frequency estimator 320 to compute the fundamental frequency, $f_0$, and the associated number of harmonics ($L=0.4627/f_0$) for the frame, where 0.4627 represents the typical vocoder bandwidth normalized by the sampling rate. These parameters are then further processed with the spectrum by a voicing decision generator 325 that computes the voicing measures, $V_l$ and a spectral magnitude generator 330 that computes the spectral magnitudes, $M_l$, for each harmonic $1 \le l \le L$.

The spectrum optionally may be further processed by a tone detection unit 335 that detects certain tone signals, such as, for example, single frequency tones, DTMF tones, and call progress tones. Tone detection techniques are well known and may be performed by searching for peaks in the spectrum and determining that a tone signal is present if the energy around one or more located peaks exceeds some threshold (for example 99%) of the total energy in the spectrum. The tone data output from the tone detection element typically includes a voice/tone flag, a tone index to identify the tone if the voice/tone flag indicates a tone signal has been detected, and the estimated tone amplitude, $A_{TONE}$.

The output 340 of the MBE parameter estimation includes the MBE parameters combined with any tone data.

The MBE parameter estimation technique shown in FIG. 3 closely follows the method described in the APCO Project 25 Vocoder Description. Differences include having voicing decision generator 325 compute a separate voicing decision for each harmonic in the half-rate vocoder, rather than for each group of three or more harmonics, and having spectral magnitude generator 330 compute each spectral magnitude independent of the voicing decisions as described, for example, in U.S. Pat. No. 5,754,974, which is incorporated by reference. In addition, the optional tone detection unit 335 may be included in the half-rate vocoder to detect tone signals for transmission through the vocoder using special tone frames of bits which are recognized by the decoder.

Figure 4:
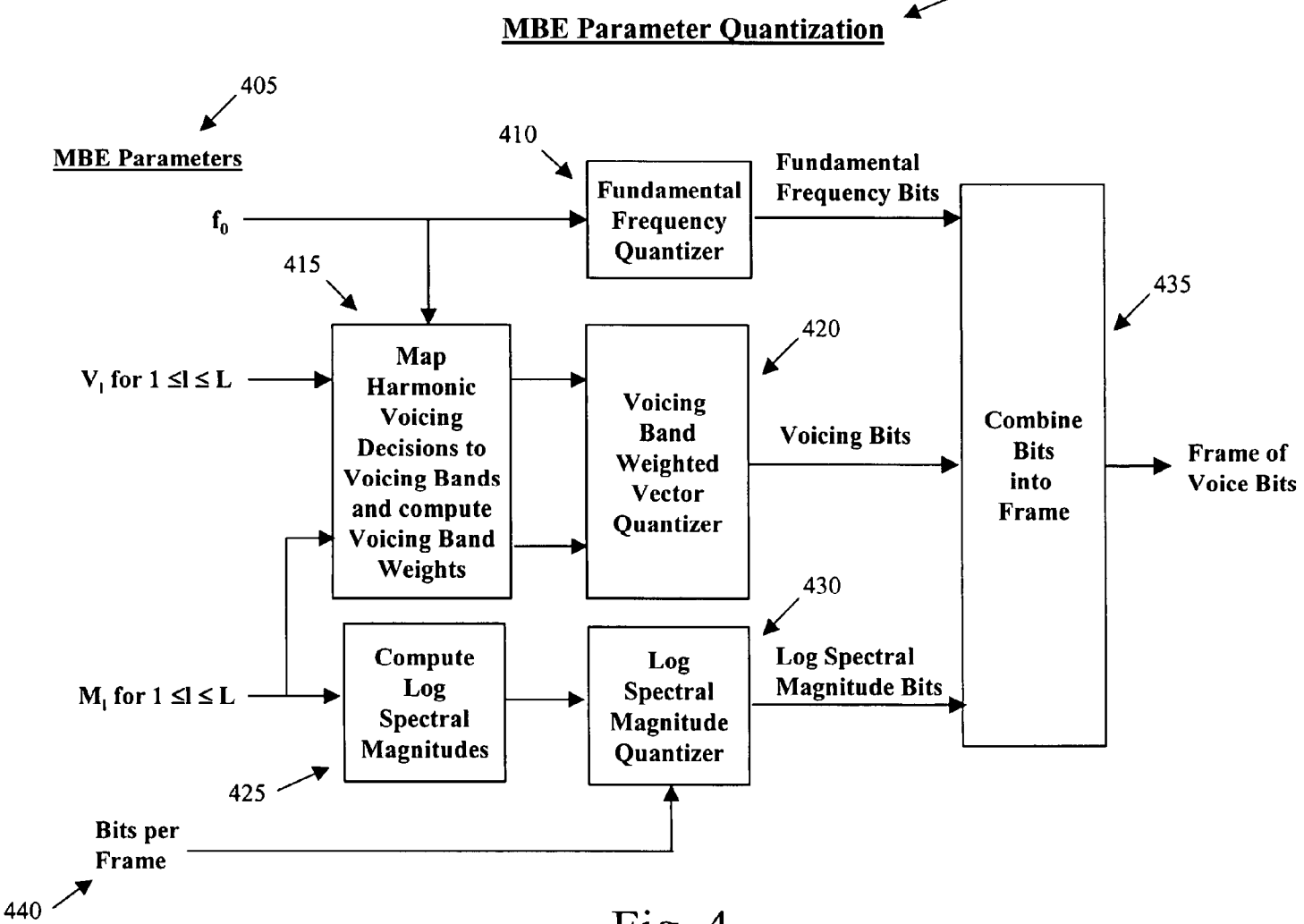
FIG. 4 is a block diagram of an implementation of a MBE parameter quantizer such as may be used in the half-rate MBE encoder of FIG. 2.

FIG. 4 illustrates a MBE parameter quantization technique 400 that constitutes one implementation of the quantization performed by the MBE parameter quantization unit 210 of FIG. 2. Additional details regarding quantization can be found in U.S. Pat. No. 6,199,037 B1 and in the APCO Project 25 Vocoder Description, both of which are incorporated by reference. The described MBE parameter quantization method is typically only applied to voice signals, while detected tone signals are quantized using a separate tone quantizer. MBE parameters 405 are the input to the MBE parameter quantization technique. The MBE parameters 405 may be estimated using the techniques illustrated by FIG. 3. In one implementation, 42-49 bits per frame are used to quantize the MBE model parameters as shown in Table 1, where the number of bits can be independently selected for each frame in the range of 42-49 using an optional control parameter.

TABLE 1

| MBE Parameter Bits | |
|---|---|
| Parameter | Bits per Frame |
| Fundamental Frequency | 7 |
| Voicing Decisions | 5 |
| Gain | 5 |
| Spectral Magnitudes | 25-32 |
| Total Bits | 42-49 |

In this implementation the fundamental frequency, $f_0$, is typically quantized first using a fundamental frequency quantizer unit 410 that outputs 7 fundamental frequency bits, $b_{fund}$, which may be computed according to Equation [1] as follows:

$$b_{fund}=0, \text{ if } f_0>0.0503$$

$$b_{fund}=119, \text{ if } f_0<0.00811$$

$$b_{fund}=\lfloor -195.626-45.368*\log_2(f_0)\rfloor, \text{ otherwise.} \quad [1]$$

The harmonic voicing measures, $D_l$, and spectral magnitudes, $M_l$, for $1\le l\le L$, are next mapped from harmonics to voicing bands using a frequency mapping unit 415. In one implementation, 8 voicing bands are used where the first voicing band covers frequencies [0, 500 Hz], the second voicing band covers [500, 1000 Hz], . . . , and the last voicing band covers frequencies [3500, 4000 Hz]. The output of frequency mapping unit 415 is the voicing band energy metric $vener_k$ and the voicing band error metric $lv_k$, for each voicing band k in the range $0\le k<8$. Each voicing band's energy metric, $vener_k$, is computed by summing $|M_l|^2$ over all harmonics in the k'th voicing band, i.e. for $b_k<l\le b_{k+1}$, where $b_k$ is given by:

$$b_k=(k-0.25)/(16f_0)\rfloor \quad [2]$$

The voicing band metric $verr_k$ is computed by summing $D_l\cdot|M_l|^2$ over $b_k<l\le b_{k+1}$, and the voicing band error metric $lv_k$ is then computed from $verr_k$ and $vener_k$ as shown in Equation [3] below:

$$lv_k=\max[0.0,\min[1.0,0.5\cdot(1.0-\log_2(verr_k/(T_k\cdot vener_k)))]] \quad [3]$$

where max[x, y] returns the maximum of x or y and min[x, y] computes the minimum of x or y. The threshold value $T_k$ is computed according to $T_k=\Theta(k, 0.1309)$ from the threshold function $\Theta(k, \omega_0)$ defined in Equation [37] of the APCO Project 25 Vocoder Description.

Once the voicing band energy metrics $vener_k$ and the voicing band error metrics $lv_k$ for each voicing band have been computed, the voicing decisions for the frame are jointly quantized using a 5-bit voicing band weighted vector quantizer unit 420 that, in one implementation, uses the voicing band subvector quantizer described in U.S. Pat. No. 6,199,037 B1, which is incorporated by reference. The voicing band weighted vector quantizer unit 420 outputs the voicing decision bits $b_{vuv}$, where $b_{vuv}$ denotes the index of the selected candidate vector $x_j(i)$ from a voicing band codebook. A 5-bit (32 element) voicing band codebook used in one implementation is shown in Table 2.

TABLE 2

| 5 Bit Voicing Band Codebook | | | |
|---|---|---|---|
| Index: i | Candidate Vector: $x_j(i)$ | Index: i | Candidate Vector: $x_j(i)$ |
| 0 | 0xFF | 1 | 0xFF |
| 2 | 0xFE | 3 | 0xFE |
| 4 | 0xFC | 5 | 0xDF |
| 6 | 0xEF | 7 | 0xFB |
| 8 | 0xF0 | 9 | 0xF8 |
| 10 | 0xE0 | 11 | 0xE1 |
| 12 | 0xC0 | 13 | 0xC0 |
| 14 | 0x80 | 15 | 0x80 |
| 16 | 0x00 | 17 | 0x00 |
| 18 | 0x00 | 19 | 0x00 |
| 20 | 0x00 | 21 | 0x00 |
| 22 | 0x00 | 23 | 0x00 |
| 24 | 0x00 | 25 | 0x00 |
| 26 | 0x00 | 27 | 0x00 |
| 28 | 0x00 | 29 | 0x00 |
| 30 | 0x00 | 31 | 0x00 |

Note that each candidate vector $x_j(i)$ shown in Table 2 is represented as an 8-bit hexadecimal number where each bit represents a single element of an 8 element codebook vector and $x_j(i)=1.0$ if the bit corresponding to $2^{7-j}$ is a 1 and $x_j(i)=0.0$ if the bit corresponding to $2^{7-j}$ is a 0. This notation is used to be consistent with the voicing band subvector quantizer described in U.S. Pat. No. 6,199,037 B1.

One feature of the half-rate vocoder is that it includes multiple candidate vectors that each correspond to the same voicing state. For example, indices 16-31 in Table 2 all correspond to the all unvoiced state and indices 0 and 1 both correspond to the all voiced state. This feature provides an interoperable upgrade path for the vocoder that allows alternate implementations that could include pulsed or other improved voicing states. Initially, an encoder may only use the lowest valued index wherever two or more indices equate to the same voicing state. However, an upgraded encoder may use the higher valued indices to represent alternate related voicing states. The initial decoder would decode either the lowest or higher indices to the same voicing state (for example, indices 16-31 would all be decoded as all unvoiced), but upgraded decoders may decode these indices into related but different voicing states for improved performance.

FIG. 4 also depicts the processing of the spectral magnitudes by a logarithm computation unit 425 that computes the log spectral magnitudes, $\log_2(M_l)$ for $1\le l\le L$. The output log spectral magnitudes are then quantized by a log spectral magnitude quantizer unit 430 to produce output log spectral magnitude output bits.

Figure 5:
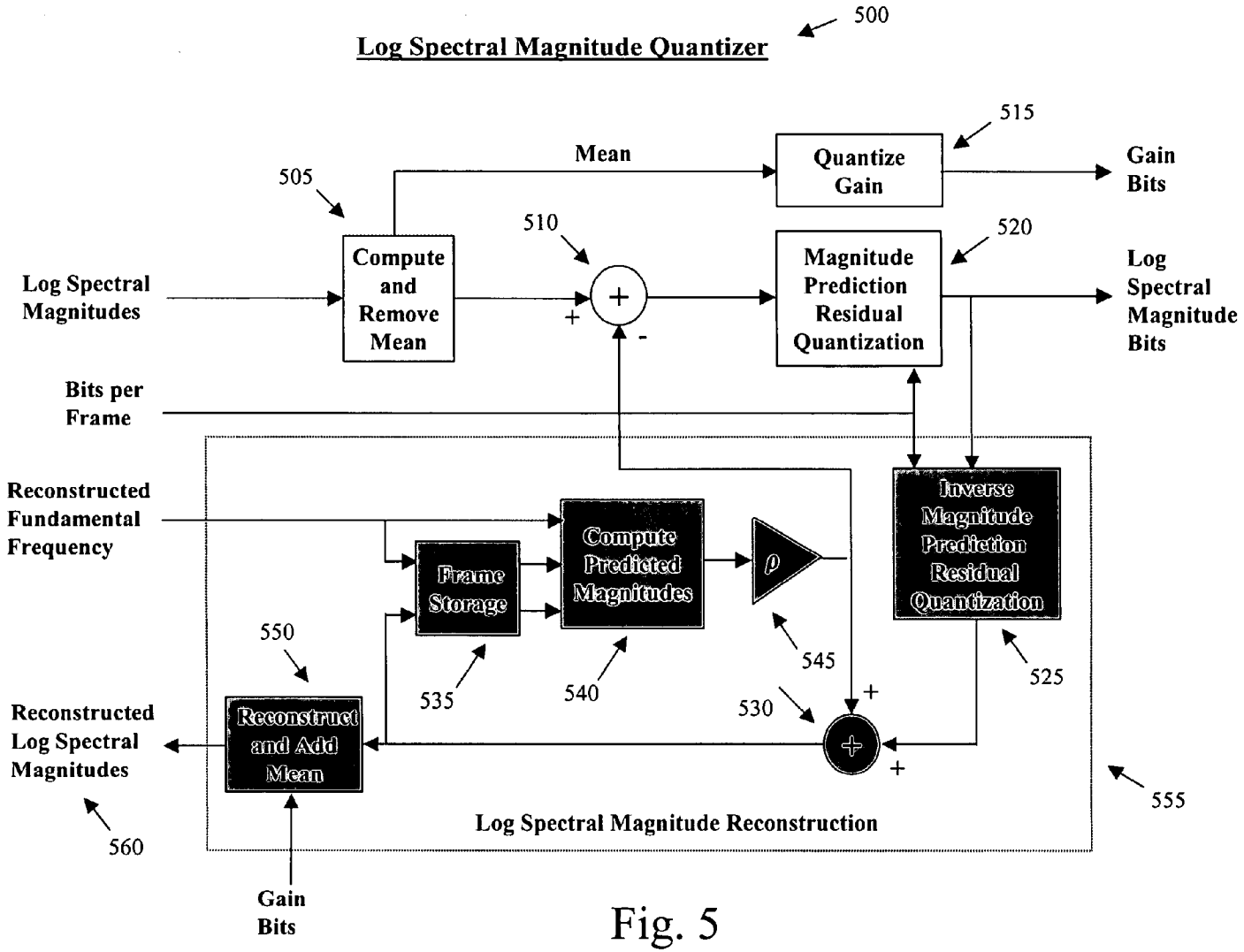
FIG. 5 is a block diagram of one implementation of a half-rate MBE log spectral magnitude quantizer of the half-rate MBE encoder of FIG. 2.

FIG. 5 shows a log spectral magnitude quantization technique 500 that constitutes one implementation of the quantization performed by the quantization unit 430 of FIG. 4. The shaded section of FIG. 5, including elements 525-550, shows a corresponding implementation of a log spectral magnitude reconstruction technique 555 that may be implemented within parameter reconstruction unit 240 of FIG. 2 to reconstruct the log spectral magnitudes from the quantizer bits output by FEC decoding unit 235.

Referring to FIG. 5, log spectral magnitudes for a frame (i.e., $\log_2(M_l)$ for $1\le l\le L$) are processed by mean computation unit 505 to compute and remove the mean from the log spectral magnitudes. The mean is output to the a gain quantizer unit 515 that computes the gain, G(0), for the current frame from the mean as shown in Equation [4]:

$$G(0)=\text{mean}\{\log_2(M_l)\}+0.5\cdot\log_2(L) \quad [4]$$

The differential gain, $\Delta_G$, is then computed as:

$$\Delta_G=G(0)-0.5\cdot G(-1) \quad [5]$$

where G(−1) is the gain term from the prior frame after quantization and reconstruction. The differential gain, $\Delta_G$, is then quantized using a 5-bit non-uniform quantizer such as that shown in Table 3. The gain bits output by the quantizer are denoted as $b_{gain}$.

TABLE 3

5 Bit Differential Gain Codebook

| Index: i | Differential Gain: $\Delta_G(i)$ | Index: i | Candidate Vector: $\Delta_G(i)$ |
|---|---|---|---|
| 0 | −2.0 | 1 | −0.67 |
| 2 | 0.2979 | 3 | 0.6637 |
| 4 | 1.0368 | 5 | 1.4381 |
| 6 | 1.8901 | 7 | 2.2280 |
| 8 | 2.4783 | 9 | 2.6676 |
| 10 | 2.7936 | 11 | 2.8933 |
| 12 | 3.0206 | 13 | 3.1386 |
| 14 | 3.2376 | 15 | 3.3226 |
| 16 | 3.4324 | 17 | 3.5719 |
| 18 | 3.6967 | 19 | 3.8149 |
| 20 | 3.9209 | 21 | 4.0225 |
| 22 | 4.1236 | 23 | 4.2283 |
| 24 | 4.3706 | 25 | 4.5437 |
| 26 | 4.7077 | 27 | 4.8489 |
| 28 | 5.0568 | 29 | 5.3265 |
| 30 | 5.7776 | 31 | 6.8745 |

The mean computation unit 505 outputs zero-mean log spectral magnitudes to a subtraction unit 510 that subtracts predicted magnitudes to produce a set of magnitude prediction residuals. The magnitude prediction residuals are input to a quantization unit 520 that produces magnitude prediction residual parameter bits.

These magnitude prediction residual parameter bits are also fed to the reconstruction technique 555 depicted in the shaded region of FIG. 5. In particular, inverse magnitude prediction residual quantization unit 525 computes reconstructed magnitude prediction residuals using the input bits, and provides the reconstructed magnitude prediction residuals to a summation unit 530 that adds them to the predicted magnitudes to form reconstructed zero-mean log spectral magnitudes that are stored in a frame storage element 535.

The zero-mean log spectral magnitudes stored from a prior frame are processed in conjunction with reconstructed fundamental frequencies for the current and prior frames by predicted magnitude computation unit 540 and then scaled by a scaling unit 545 to form predicted magnitudes that are applied to difference unit 510 and summation unit 530. Predicted magnitude computation unit 540 typically interpolates the reconstructed log spectral magnitudes from a prior frame based on the ratio of the reconstructed fundamental frequency from the current frame to the reconstructed fundamental frequency of the prior frame. This interpolation is followed by application by the scaling unit 545 of a scale factor ρ that normally is less than 1.0 (p=0.65 is typical, and in some implementations p may be varied depending on the number of spectral magnitudes in the frame).

In addition, the mean is then reconstructed from the gain bits and from the stored value of G(−1) in a mean reconstruction unit 550 that also adds the reconstructed mean to the reconstructed magnitude prediction residuals to produce reconstructed log spectral magnitudes 560.

Figure 6:
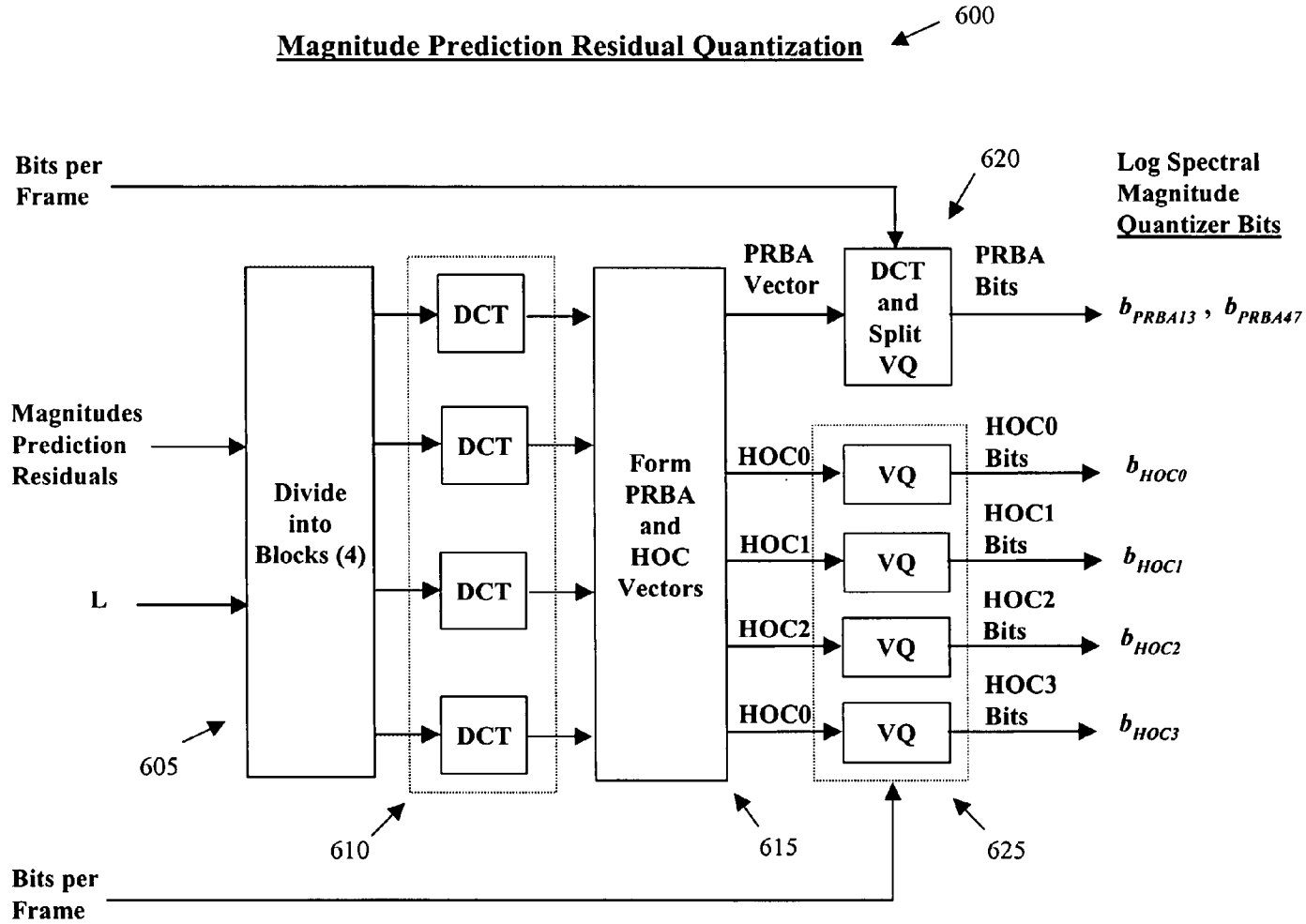
FIG. 6 is a block diagram of a spectral magnitude prediction residual quantizer of the half-rate MBE encoder of FIG. 2.

In the implementation shown in FIG. 5, quantization unit 520 and inverse quantization unit 525 accept an optional control parameter that allows the number of bits per frame to be selected within some allowable range of bits (for example 25-32 bits per frame). Typically, the bits per frame are varied by using only a subset of the allowable quantization vectors in quantization unit 510 and inverse quantization unit 515 as further described below. This same control parameter can be used in several ways to vary the number of bits per frame over a wider range if necessary. For example, this may be done by also reducing the number of bits from the gain quantizer by searching only the even indices 0, 2, 4, 6, . . . 32 in Table 3. This method can also be applied to the fundamental frequency or voicing quantizer. FIG. 6 shows a magnitude prediction residual quantization technique 600 that constitutes one implementation of the quantization performed by the quantization unit 520 of FIG. 5. First, a block divider 605 divides magnitude prediction residuals into four blocks, with the length of each block typically being determined by the number of harmonics, L, as shown in Table 4. Lower frequency blocks are generally equal or smaller in size compared to higher frequency blocks to improve performance by placing more emphasis on the perceptually more important low frequency regions. Each block is then transformed with a separate Discrete Cosine Transform (DCT) unit 610 and the DCT coefficients are divided into an eight element PRBA vector (using the first two DCT coefficients of each block) and four HOC vectors (one for each block consisting of all but the first two DCT coefficients) by a PRBA and HOC vector formation unit 615. The formation of the PRBA vector uses the first two DCT coefficients for each block transformed and arranged as follows:

$$PRBA(0)=\text{Block}_0(0)+1.414\cdot\text{Block}_0(1)$$

$$PRBA(1)=\text{Block}_0(0)-1.414\cdot\text{Block}_0(1)$$

$$PRBA(2)=\text{Block}_1(0)+1.414\cdot\text{Block}_1(1)$$

$$PRBA(3)=\text{Block}_1(0)-1.414\cdot\text{Block}_1(1)$$

$$PRBA(4)=\text{Block}_2(0)+1.414\cdot\text{Block}_2(1)$$

$$PRBA(5)=\text{Block}_2(0)-1.414\cdot\text{Block}_2(1)$$

$$PRBA(6)=\text{Block}_3(0)+1.414\cdot\text{Block}_3(1)$$

$$PRBA(7)=\text{Block}_3(0)-1.414\cdot\text{Block}_3(1) \quad [6]$$

where PRBA(n) is the n'th element of the PRBA vector and $\text{Block}_j(k)$ is the k'th element of the j'th block.

TABLE 4

Magnitude Prediction Residual Block Size

| L | $\text{Block}_0$ | $\text{Block}_1$ | $\text{Block}_2$ | $\text{Block}_3$ |
|---|---|---|---|---|
| 9 | 2 | 2 | 2 | 3 |
| 10 | 2 | 2 | 3 | 3 |
| 11 | 2 | 3 | 3 | 3 |
| 12 | 2 | 3 | 3 | 4 |
| 13 | 3 | 3 | 3 | 4 |
| 14 | 3 | 3 | 4 | 4 |
| 15 | 3 | 3 | 4 | 5 |
| 16 | 3 | 4 | 4 | 5 |
| 17 | 3 | 4 | 5 | 5 |
| 18 | 4 | 4 | 5 | 5 |
| 19 | 4 | 4 | 5 | 6 |
| 20 | 4 | 4 | 6 | 6 |
| 21 | 4 | 5 | 6 | 6 |
| 22 | 4 | 5 | 6 | 7 |
| 23 | 5 | 5 | 6 | 7 |
| 24 | 5 | 5 | 7 | 7 |
| 25 | 5 | 6 | 7 | 7 |
| 26 | 5 | 6 | 7 | 8 |
| 27 | 5 | 6 | 8 | 8 |
| 28 | 6 | 6 | 8 | 8 |
| 29 | 6 | 6 | 8 | 9 |
| 30 | 6 | 7 | 8 | 9 |

TABLE 4-continued

| Magnitude Prediction Residual Block Size | | | | |
|---|---|---|---|---|
| L | $Block_0$ | $Block_1$ | $Block_2$ | $Block_3$ |
| 31 | 6 | 7 | 9 | 9 |
| 32 | 6 | 7 | 9 | 10 |
| 33 | 7 | 7 | 9 | 10 |
| 34 | 7 | 8 | 9 | 10 |
| 35 | 7 | 8 | 10 | 10 |
| 36 | 7 | 8 | 10 | 11 |
| 37 | 8 | 8 | 10 | 11 |
| 38 | 8 | 9 | 10 | 11 |
| 39 | 8 | 9 | 11 | 11 |
| 40 | 8 | 9 | 11 | 12 |
| 41 | 8 | 9 | 11 | 13 |
| 42 | 8 | 9 | 12 | 13 |
| 43 | 8 | 10 | 12 | 13 |
| 44 | 9 | 10 | 12 | 13 |
| 45 | 9 | 10 | 12 | 14 |
| 46 | 9 | 10 | 13 | 14 |
| 47 | 9 | 11 | 13 | 14 |
| 48 | 10 | 11 | 13 | 14 |
| 49 | 10 | 11 | 13 | 15 |
| 50 | 10 | 11 | 14 | 15 |
| 51 | 10 | 12 | 14 | 15 |
| 52 | 10 | 12 | 14 | 16 |
| 53 | 11 | 12 | 14 | 16 |
| 54 | 11 | 12 | 15 | 16 |
| 55 | 11 | 12 | 15 | 17 |
| 56 | 11 | 13 | 15 | 17 |

The PRBA vector is processed further using an eight-point DCT followed by a split vector quantizer unit 620 to produce PRBA bits. In one implementation, the first PRBA DCT coefficient (designated $R_0$) is ignored since it is redundant with the Gain value quantized separately. Alternately, this first PRBA DCT coefficient can be quantized in place of the gain as described in the APCO Project 25 Vocoder Description. The final seven PRBA DCT coefficients [$R_1$-$R_7$] are then quantized with a split vector quantizer that uses a nine-bit codebook to quantize the three elements [$R_1$-$R_3$] to produce PRBA quantizer bits $b_{PRBA13}$ and a seven-bit codebook is used to quantize the four elements [$R_4$-$R_7$] to produce PRBA quantizer bits $b_{PRBA47}$. These 16 PRBA quantizer bits ($b_{PRBA13}$ and $b_{PRBA47}$) are then output from the quantizer. Typical split VQ codebooks used to quantize the PRBA vector are given in Appendix A.

The four HOC vectors, designated HOC0, HOC1, HOC2 and HOC3, are then quantized using four separate codebooks 625. In one implementation, a five-bit codebook is used for HOC0 to produce HOC0 quantizer bits $b_{HOC0}$; four-bit codebooks are used for HOC1 and HOC2 to produce HOC1 quantizer bits $b_{HOC1}$ and HOC2 quantizer bits $b_{HOC2}$; and a 3 bit codebook is used for HOC3 to produce HOC3 quantizer bits $b_{HOC3}$. Typical codebooks used to quantize the HOC vectors in this implementation are shown in Appendix B. Note that each HOC vector can vary in length between 0 and 15 elements. However, the codebooks are designed for a maximum of four elements per vector. If a HOC vector has less than four elements, then only the first elements of each codebook vector are used by the quantizer. Alternately, if the HOC vector has more than four elements, then only the first four elements are used and all other elements in that HOC vector are set equal to zero. Once all the HOC vectors are quantized, the 16 HOC quantizer bits ($b_{HOC0}$, $b_{HOC1}$, $b_{HOC2}$, and $b_{HOC3}$) are output by the quantizer In the implementation shown in FIG. 6, the vector quantizer units 620 and/or 625 accept an optional control parameter that allows the number of bits per frame used to quantize the PRBA and HOC vectors to be selected within some allowable range of bits. Typically, the bits per frame are reduced from the nominal value of 32 by using only a subset of the allowable quantization vectors in one or more of the codebooks used by the quantizer. For example, if only the even candidate vectors in a codebook are used, then the last bit of the codebook index is known to be a zero, allowing the number of bits to be reduced by one. This can be extended to every fourth vector to allow the number of bits to be reduced by two.

At the decoder, the codebook index is reconstructed by appending the appropriate number of '0' bits in place of any missing bits to allow the quantized codebook vector to be determined. This approach is applied to one or more of the HOC and/or PRBA codebooks to obtain the selected number of bits for the frame as shown in Table 5, where the number of magnitude prediction residual quantizer bits is typically determined as an offset from the number of voice bits in the frame (i.e., the number of voice bits minus 17).

TABLE 5

| Magnitude Prediction Residual Quantizer Bits per Frame | | | | | | |
|---|---|---|---|---|---|---|
| Magnitude Prediction Residual Quantizer Bits per Frame | PRBA [$R_1$-$R_3$] | PRBA [$R_4$-$R_7$] | HOC0 | HOC1 | HOC2 | HOC3 |
| 32 | 9 | 7 | 5 | 4 | 4 | 3 |
| 31 | 9 | 7 | 5 | 4 | 4 | 2 |
| 30 | 9 | 7 | 5 | 4 | 4 | 1 |
| 29 | 9 | 7 | 5 | 4 | 3 | 1 |
| 28 | 9 | 7 | 5 | 3 | 3 | 1 |
| 27 | 9 | 7 | 4 | 3 | 3 | 1 |
| 26 | 9 | 6 | 4 | 3 | 3 | 1 |
| 25 | 8 | 6 | 4 | 3 | 3 | 1 |

Referring to FIG. 4, combining unit 435 receives fundamental frequency or pitch bits $b_{fund}$, voicing $b_{vuv}$, gain bits $b_{gain}$, and spectral bits $b_{PRBA13}$, $b_{PRBA47}$,$b_{HOC0}$, $b_{HOC1}$, $b_{HOC2}$, and $b_{HOC}$, from quantizer units 410, 420 and 430. Typically, combining unit 435 prioritizes these input bits to produce output voice bits such that the first voice bits in the frame are more sensitive to bit errors, while the later voice bits in the frame are less sensitive to bit errors. This prioritization allows FEC to be applied efficiently to the most sensitive voice bits, resulting in improved voice quality and robustness in degraded communication channels. In one such implementation, the first 12 voice bits in a frame output by combining unit 435 consist of the four most significant fundamental frequency bits, followed by the first four voicing decision bits and the four most significant gain bits. The resulting voice frame format (i.e., the ordering of the output voice bits after prioritization by combining unit 435) is shown in Table 6.

TABLE 6

| Voice Frame Format | |
|---|---|
| Bit Position in Voice Frame | Voice Bits |
| 0-3 | 4 most significant bits of $b_{fund}$ |
| 4-7 | 4 most significant bits of $b_{vuv}$ |
| 8-11 | 4 most significant bits of $b_{gain}$ |
| 12-19 | 8 most significant bits of $b_{PBBA13}$ |
| 20-23 | 4 most significant bits of $b_{PBBA47}$ |
| 24-27 | 4 most significant bits of $b_{HOC0}$ |
| 28-30 | 3 most significant bits of $b_{HOC1}$ |
| 31-33 | 3 most significant bits of $b_{HOC2}$ |
| 34 | 1 most significant bit of $b_{HOC3}$ |

TABLE 6-continued

| Voice Frame Format | |
|---|---|
| Bit Position in Voice Frame | Voice Bits |
| 35 | 1 least significant bit of $b_{vuv}$ |
| 36 | 1 least significant bit of $b_{gain}$ |
| 37-39 | 3 least significant bits of $b_{fund}$ |
| 40 | 1 least significant bit of $b_{PBBA13}$ |
| 41-43 | 3 least significant bits of $b_{PBBA47}$ |
| 44 | 1 least significant bits of $b_{HOC0}$ |
| 45 | 1 least significant bits of $b_{HOC1}$ |
| 46 | 1 least significant bits of $b_{HOC2}$ |
| 47-48 | 2 least significant bits of $b_{HOC3}$ |

Referring again to FIG. 2, the encoder may include a tone quantization unit 215 that outputs a frame of tone bits (i.e., a tone frame) if certain tone signals (such as a single frequency tone, Knox tones, a DTMF tone and/or a call progress tone) are detected in the encoder input signal. In one implementation, tone bits are generated as shown in Table 7, where the first 6 bits are all ones (hexadecimal value 0x3F) to allow the decoder to uniquely identify a tone frame from other frames containing voice bits (i.e., voice frames). This unique differentiation is possible because of limits on the value of $b_{fund}$ imposed by Equation [1], which prevent the tone frame identifier value (0x3F) from ever occurring for voice frames and because the tone frame identifier overlaps the same position in the frame as the four most significant pitch bits, $b_{fund}$, as shown in Table 6. The seven tone amplitude bits $b_{TONEAMP}$ are computed from the estimated tone amplitude, $A_{TONE}$, as follows:

$$b_{TONEAMP}=\max[0,\min[127,8.467\cdot(\log_2(A_{TONE})+1)]] \quad [4]$$

while the 8-bit tone index, $b_{TONE}$ used to represent a given tone signal is shown in Appendix C. Typically, the tone index $b_{TONE}$ is repeated several times within a tone frame in order to increase robustness to channel errors. This is depicted in Table 7, where the tone index is repeated four times within the frame of 49 bits.

TABLE 7

| Tone Frame Format | |
|---|---|
| Bit Position in Frame | Tone Bits |
| 0-5 | 0x3F |
| 6-11 | first 6 most significant bits of $b_{TONEAMP}$ |
| 12-19 | $b_{TONE}$ |
| 20-27 | $b_{TONE}$ |
| 28-35 | $b_{TONE}$ |
| 36-43 | $b_{TONE}$ |
| 44 | 7'th least significant bit of $b_{TONEAMP}$ |
| 45-48 | 0 |

While the techniques are described largely in the context of a new half-rate MBE vocoder, the described techniques may be readily applied to other systems and/or vocoders. For example, other MBE type vocoders may also benefit from the techniques regardless of the bit rate or frame size. In addition, the techniques described may be applicable to many other speech coding systems that use a different speech model with alternative parameters (such as STC, MELP, MB-HTC, CELP, HVXC or others) or which use different methods for analysis, quantization and/or synthesis. Other implementations are within the scope of the following claims.

What is claimed is:

1. A speech coder configured to encode a sequence of digital speech samples into a bit stream, the speech coder being operable to:

divide the digital speech samples into one or more frames;

compute model parameters for a frame;

quantize the model parameters to produce pitch bits conveying pitch information, voicing bits conveying voicing information, and gain bits conveying signal level information, wherein the pitch bits, the voicing bits and the gain bits are included in quantizer bits for the frame;

combine one or more of the pitch bits with one or more of the voicing bits and one or more of the gain bits to create a first parameter codeword that includes less than all of the quantizer bits for the frame;

encode the first parameter codeword with an error control code to produce a first FEC ("forward error control") codeword; and include the first FEC codeword in a bit stream for the frame.

2. The speech coder of claim 1, wherein the speech coder is operable to compute the model parameters for the frame by computing a fundamental frequency parameter, one or more of voicing decisions, and a set of spectral parameters.

3. The speech coder of claim 1, wherein the speech coder is operable to compute the model parameters for a frame using the Multi-Band Excitation speech model.

4. The speech coder of claim 2, wherein the speech coder, in quantizing the model parameters, produces the pitch bits by applying a logarithmic function to the fundamental frequency parameter.

5. The speech coder of claim 3, wherein the speech coder, in quantizing the model parameters, produces the voicing bits by jointly quantizing voicing decisions for the frame.

6. The speech coder of claim 5, wherein:

the voicing bits represent an index into a voicing codebook, and the value of the voicing codebook is the same for two or more different values of the index.

7. The speech coder of claim of claim 1, wherein the first parameter codeword comprises twelve bits.

8. The speech coder of claim 7, wherein the speech coder is operable to form the first parameter codeword by combining four of the pitch bits, plus four of the voicing bits, plus four of the gain bits.

9. The speech coder of claim 8, wherein the speech coder is operable to encode the first parameter codeword with a Golay error control code.

10. The speech coder of claim 8, wherein:

the spectral parameters include a set of logarithmic spectral magnitudes, and the speech coder is operable to produce the gain bits at least in part by computing the mean of the logarithmic spectral magnitudes.

11. The speech coder of claim 10, wherein the speech coder is operable to:

quantize the logarithmic spectral magnitudes into spectral bits;

combine a plurality of the spectral bits to create a second parameter codeword;

encode the second parameter codeword with a second error control code to produce a second FEC codeword; and include the second FEC codeword in the bit stream for the frame.

12. The speech coder of claim 11, wherein:

the pitch bits, voicing bits, gain bits and spectral bits are each divided into more important bits and less important bits, the speech coder is operable to include the more important pitch bits, voicing bits, gain bits, and spectral bits in the first parameter codeword and the second parameter codeword and encoded with error control codes, and the speech coder is operable to include the less important pitch bits, voicing bits, gain bits, and spectral bits in the bit stream for the frame without encoding with error control codes.

13. The speech coder of claim 12, wherein:

there are 7 pitch bits divided into 4 more important pitch bits and 3 less important pitch bits, there are 5 voicing bits divided into 4 more important voicing bits and 1 less important voicing bit, and there are 5 gain bits divided into 4 more important gain bits and 1 less important gain bit.

14. The speech coder of claim 13, wherein the second parameter code comprises twelve more important spectral bits which the speech coder is operable to encode with a Golay error control code to produce the second FEC codeword.

15. The speech coder of claim 14, wherein the speech coder is operable to:

compute a modulation key from the first parameter codeword;

generate a scrambling sequence from the modulation key;

combine the scrambling sequence with the second FEC codeword to produce a scrambled second FEC codeword; and include the scrambled second FEC codeword in the bit stream for the frame.

16. The speech coder of claim 14, wherein the speech coder is operable to:

detect certain tone signals; and if a tone signal is detected for a frame, include tone identifier bits and tone amplitude bits in the first parameter codeword, wherein the tone identifier bits allow the bits for the frame to be identified as corresponding to a tone signal.

17. The speech coder of claim 16, wherein the speech coder is operable to, if a tone signal is detected for a frame, include additional tone index bits in the bit stream for the frame, where the tone index bits determine frequency information for the tone signal.

18. The speech coder of claim 17, wherein the tone identifier bits correspond to a disallowed set of pitch bits to permit the bits for the frame to be identified as corresponding to a tone signal.

19. The speech coder of claim 18, wherein the first parameter codeword comprises six tone identifier bits and six tone amplitude bits if a tone signal is detected for a frame.

20. The speech coder of claim 7, wherein the speech coder is operable to encode the first parameter codeword with a Golay error control code.

21. The speech coder of claim 7, wherein the speech coder is operable to:

detect certain tone signals; and if a tone signal is detected for a frame, include tone identifier bits and tone amplitude bits in the first parameter codeword, wherein the tone identifier bits allow the bits for the frame to be identified as corresponding to a tone signal.

22. The speech coder of claim 21, wherein the speech coder is operable to, if a tone signal is detected for a frame, include additional tone index bits in the bit stream for the frame, where the tone index bits determine frequency information for the tone signal.

23. The speech coder of claim 22, wherein the tone identifier bits correspond to a disallowed set of pitch bits to permit the bits for the frame to be identified as corresponding to a tone signal.

24. The speech coder of claim 23, wherein the first parameter codeword comprises six tone identifier bits and six tone amplitude bits if a tone signal is detected for a frame.

25. The speech coder of claim 6, wherein:

the spectral parameters include a set of logarithmic spectral magnitudes, and the speech coder is operable to produce the gain bits at least in part by computing the mean of the logarithmic spectral magnitudes.

26. The speech coder of claim 25, wherein the speech coder is operable to:

quantize the logarithmic spectral magnitudes into spectral bits;

combine a plurality of the spectral bits to create a second parameter codeword;

encode the second parameter codeword with a second error control code to produce a second FEC codeword; and include the second FEC codeword in the bit stream for the frame.

27. The speech coder of claim 26, wherein:

the pitch bits, voicing bits, gain bits and spectral bits are each divided into more important bits and less important bits, the speech coder is operable to include the more important pitch bits, voicing bits, gain bits, and spectral bits in the first parameter codeword and the second parameter codeword and encoded with error control codes, and the speech coder is operable to include the less important pitch bits, voicing bits, gain bits, and spectral bits in the bit stream for the frame without encoding with error control codes.

28. The speech coder of claim 27, wherein:

there are 7 pitch bits divided into 4 more important pitch bits and 3 less important pitch bits, there are 5 voicing bits divided into 4 more important voicing bits and 1 less important voicing bit, and there are 5 gain bits divided into 4 more important gain bits and 1 less important gain bit.

29. The speech coder of claim 28, wherein the second parameter code comprises twelve more important spectral bits which the speech coder is operable to encode with a Golay error control code to produce the second FEC codeword.

30. The speech coder of claim 29, wherein the speech coder is operable to:

compute a modulation key from the first parameter codeword;

generate a scrambling sequence from the modulation key;

combine the scrambling sequence with the second FEC codeword to produce a scrambled second FEC codeword; and include the scrambled second FEC codeword in the bit stream for the frame.

31. The speech coder of claim 2, wherein:

the spectral parameters include a set of logarithmic spectral magnitudes, and the speech coder is operable to produce the gain bits at least in part by computing the mean of the logarithmic spectral magnitudes.

32. The speech coder of claim 31, wherein the speech coder is operable to:

quantize the logarithmic spectral magnitudes into spectral bits;

combine a plurality of the spectral bits to create a second parameter codeword;

encode the second parameter codeword with a second error control code to produce a second FEC codeword; and include the second FEC codeword in the bit stream for the frame.

33. The speech coder of claim 32, wherein:

the pitch bits, voicing bits, gain bits and spectral bits are each divided into more important bits and less important bits, the speech coder is operable to include the more important pitch bits, voicing bits, gain bits, and spectral bits in the first parameter codeword and the second parameter codeword and encoded with error control codes, and the speech coder is operable to include the less important pitch bits, voicing bits, gain bits, and spectral bits in the bit stream for the frame without encoding with error control codes.

34. The speech coder of claim 33, wherein:

there are 7 pitch bits divided into 4 more important pitch bits and 3 less important pitch bits, there are 5 voicing bits divided into 4 more important voicing bits and 1 less important voicing bit, and there are 5 gain bits divided into 4 more important gain bits and 1 less important gain bit.

35. The speech coder of claim 34, wherein the second parameter code comprises twelve more important spectral bits which the speech coder is operable to encode with a Golay error control code to produce the second FEC codeword.

36. The speech coder of claim 35, wherein the speech coder is operable to:

compute a modulation key from the first parameter codeword;

generate a scrambling sequence from the modulation key;

combine the scrambling sequence with the second FEC codeword to produce a scrambled second FEC codeword; and include the scrambled second FEC codeword in the bit stream for the frame.

37. The speech coder of claim 1, wherein the speech coder is operable to encode the first parameter codeword with a Golay error control code.

38. The speech coder of claim 1, wherein the speech coder is operable to:

detect certain tone signals; and if a tone signal is detected for a frame, include tone identifier bits and tone amplitude bits in the first parameter codeword, wherein the tone identifier bits allow the bits for the frame to be identified as corresponding to a tone signal.

39. The speech coder of claim 38, wherein the speech coder is operable to, if a tone signal is detected for a frame, include additional tone index bits in the bit stream for the frame, where the tone index bits determine frequency information for the tone signal.

40. The speech coder of claim 39, wherein the tone identifier bits correspond to a disallowed set of pitch bits to permit the bits for the frame to be identified as corresponding to a tone signal.

41. The speech coder of claim 40, wherein the first parameter codeword comprises six tone identifier bits and six tone amplitude bits if a tone signal is detected for a frame.

42. A speech decoder configured to decode digital speech samples from a bit stream, the speech decoder being operable to:

divide the bit stream into one or more frames of bits;

extract a first FEC ("forward error control") codeword from a frame of bits;

error control decode the first FEC codeword to produce a first parameter codeword;

extract pitch bits, voicing bits and gain bits from the first parameter codeword, the extracted pitch bits, voicing bits and gain bits including less than all of a set of quantizer bits for the frame;

use the extracted pitch bits to at least in part reconstruct pitch information for the frame;

use the extracted voicing bits to at least in part reconstruct voicing information for the frame;

use the extracted gain bits to at least in part reconstruct signal level information for the frame; and use the reconstructed pitch information, voicing information and signal level information for one or more frames to compute digital speech samples.

43. The speech decoder of claim 42, wherein the pitch information for a frame includes a fundamental frequency parameter, and the voicing information for a frame includes one or more voicing decisions.

44. The speech decoder of claim 43, wherein the speech decoder is operable to reconstruct voicing decisions for the frame by using the voicing bits as an index into a voicing codebook.

45. The speech decoder of claim 44, wherein the value of the voicing codebook is the same for two or more different indices.

46. The speech decoder of claim 43, wherein the speech decoder is operable to reconstruct spectral information for a frame.

47. The speech decoder of claim 46, wherein:

the spectral information for a frame comprises at least in part a set of logarithmic spectral magnitude parameters, and the speech decoder is operable to use signal level information to determine the mean value of the logarithmic spectral magnitude parameters.

48. The speech decoder of claim 47, wherein:

the speech decoder is operable to decode the first FEC codeword with a Golay decoder, and the speech decoder is operable to extract four pitch bits, plus four voicing bits, plus four gain bits from the first parameter codeword.

49. The speech decoder of claim 47, wherein the speech decoder is further operable to:

generate a modulation key from the first parameter codeword;

compute a scrambling sequence from the modulation key;

extract a second FEC codeword from the frame of bits;

apply the scrambling sequence to the second FEC codeword to produce a descrambled second FEC codeword;

error control decode the descrambled second FEC codeword to produce a second parameter codeword;

compute an error metric from the error control decoding of the first FEC codeword and from the error control decoding of the descrambled second FEC codeword; and apply frame error processing if the error metric exceeds a threshold value.

50. The speech decoder of claim 49, wherein the frame error processing includes repeating the reconstructed model parameter from a previous frame for the current frame.

51. The speech decoder of claim 50, wherein the error metric uses the sum of the number of errors corrected by error control decoding the first FEC codeword and by error control decoding the descrambled second FEC codeword.

52. The speech decoder of claim 50, wherein the speech decoder is operable to reconstruct the spectral information for a frame at least in part from the second parameter codeword.

53. A speech decoder configured to decode digital speech samples from a bit stream, the speech decoder being operable to:

divide the bit stream into one or more frames of bits;

extract a first FEC ("forward error control") codeword from a frame of bits;

error control decode the first FEC codeword to produce a first parameter codeword;

use the first parameter codeword to determine whether the frame of bits corresponds to a tone signal;

extract tone amplitude bits from the first parameter codeword if the frame of bits is determined to correspond to a tone signal, otherwise extract pitch bits, voicing bits, and gain bits from the first codeword if the frame of bits is determined to not correspond to a tone signal, the extracted pitch bits, voicing bits and gain bits including less than all of a set of quantizer bits for the frame; and use either the tone amplitude bits or the pitch bits, voicing bits and gain bits to compute digital signal samples.

54. The speech decoder of claim 53, wherein the speech decoder is operable to:

generate a modulation key from the first parameter codeword;

compute a scrambling sequence from the modulation key;

extract a second FEC codeword from the frame of bits;

apply the scrambling sequence to the second FEC codeword to produce a descrambled second FEC codeword;

error control decode the descrambled second FEC codeword to produce a second parameter codeword; and compute digital signal samples using the second parameter codeword.

55. The speech decoder of claim 54, wherein the speech decoder is operable to:

sum the number of errors corrected by the error control decoding of the first FEC codeword and by the error control decoding of the descrambled second FEC codeword to compute an error metric; and apply frame error processing if the error metric exceeds a threshold, wherein the frame error processing includes repeating the reconstructed model parameter from a previous frame.

56. The speech decoder of claim 54, wherein the speech decoder is operable to extract additional spectral bits from the second parameter codeword and use the additional spectral bits to reconstruct the digital signal samples.

57. The speech decoder of claim 56, wherein the spectral bits include tone index bits if the frame of bits is determined to correspond to a tone signal.

58. The speech decoder of claim 57, wherein the speech decoder is operable to determine that the frame of bits corresponds to a tone signal if some of the bits in the first parameter codeword equal a known tone identifier value which corresponds to a disallowed value of the pitch bits.

59. The speech decoder of claim 58, wherein the tone index bits are used to identify whether the frame of bits corresponds to a signal frequency tone, a DTMF tone, a Knox tone or a call progress tone.

60. The speech decoder of claim 57, wherein the speech decoder is operable to:

use the spectral bits to reconstruct a set of logarithmic spectral magnitude parameters for the frame, and use the gain bits to determine the mean value of the logarithmic spectral magnitude parameters.

61. The speech decoder of claim 60, wherein the speech decoder is operable to use the voicing bits as an index into a voicing codebook to reconstruct voicing decisions for the frame.

62. The speech decoder of claim 60, wherein:

the speech decoder is operable to decode the first FEC codeword with a Golay decoder, and the speech decoder is operable to extract four pitch bits, plus four voicing bits, plus four gain bits from the first parameter codeword.

63. The speech decoder of claim 56, wherein the speech decoder is operable to use the voicing bits as an index into a voicing codebook to reconstruct voicing decisions for the frame.

64. The speech decoder of claim 53, wherein the speech decoder is operable to use the voicing bits as an index into a voicing codebook to reconstruct voicing decisions for the frame.

65. A speech decoder configured to decode a frame of bits into speech samples, the speech decoder being operable to:

determine the number of bits in the frame of bits;

extract spectral bits from the frame of bits;

use one or more of the spectral bits to form a spectral codebook index, wherein the index is determined at least in part by the number of bits in the frame of bits;

reconstruct spectral information using the spectral codebook index; and compute speech samples using the reconstructed spectral information.

66. The speech decoder of claim 65, wherein the speech decoder is operable to also extract pitch bits, voicing bits and gain bits from the frame of bits.

67. The speech decoder of claim 66, wherein the speech decoder is operable to use the voicing bits as an index into a voicing codebook to reconstruct voicing information which is also used to compute the speech samples.

68. The speech decoder of claim 67, wherein the speech decoder is operable to determine that the frame of bits corresponds to a tone signal if some of the pitch bits and some of the voicing bits equal a known tone identifier value.

69. The speech decoder of claim 68, wherein the spectral information includes a set of logarithmic spectral magnitude parameters, and the speech decoder is operable to use the gain bits to determine the mean value of the logarithmic spectral magnitude parameters.

70. The speech decoder of claim 69, wherein the speech decoder is operable to reconstruct the logarithmic spectral magnitude parameters for a frame using the extracted spectral bits for the frame combined with the reconstructed logarithmic spectral magnitude parameters from a previous frame.

71. The speech decoder of claim 69, wherein the speech decoder is operable to determine the mean value of the logarithmic spectral magnitude parameters for a frame from the extracted gain bits for the frame and from the mean value of the logarithmic spectral magnitude parameters of a previous frame.

72. The speech decoder of claim 69, wherein the frame of bits includes 7 pitch bits representing the fundamental frequency, 5 voicing bits representing voicing decisions, and 5 gain bits representing the signal level.

73. The speech decoder of claim 67, wherein:

the spectral information includes a set of logarithmic spectral magnitude parameters, and the speech decoder is operable to use the gain bits to determine the mean value of the logarithmic spectral magnitude parameters.

74. The speech decoder of claim 73, wherein the speech decoder is operable to reconstruct the logarithmic spectral magnitude parameters for a frame using the extracted spectral bits for the frame combined with the reconstructed logarithmic spectral magnitude parameters from a previous frame.

75. The speech decoder of claim 73, wherein the speech decoder is operable to determine the mean value of the logarithmic spectral magnitude parameters for a frame from the extracted gain bits for the frame and from the mean value of the logarithmic spectral magnitude parameters of a previous frame.

76. The speech decoder of claim 73, wherein the frame of bits includes 7 pitch bits representing the fundamental frequency, 5 voicing bits representing voicing decisions, and 5 gain bits representing the signal level.

77. The speech decoder of claim 66, wherein:

the spectral information includes a set of logarithmic spectral magnitude parameters, and the speech decoder is operable to use the gain bits to determine the mean value of the logarithmic spectral magnitude parameters.

78. The speech decoder of claim 77, wherein the speech decoder is operable to reconstruct the logarithmic spectral magnitude parameters for a frame using the extracted spectral bits for the frame combined with the reconstructed logarithmic spectral magnitude parameters from a previous frame.

79. The speech decoder of claim 77, wherein the speech decoder is operable to determine the mean value of the logarithmic spectral magnitude parameters for a frame from the extracted gain bits for the frame and from the mean value of the logarithmic spectral magnitude parameters of a previous frame.

80. The speech decoder of claim 66, wherein the frame of bits includes 7 pitch bits representing the fundamental frequency, 5 voicing bits representing voicing decisions, and 5 gain bits representing the signal level.

* * * * *